United States Patent [19]

Bobeczko

[11] Patent Number: 4,936,467

[45] Date of Patent: Jun. 26, 1990

[54] SPORTS EQUIPMENT RACK

[76] Inventor: James D. Bobeczko, 9940 Cypress Cir., Concord Township,Lake County, Ohio 44060

[21] Appl. No.: 297,203

[22] Filed: Jan. 17, 1989

[51] Int. Cl.[5] ..... A74F 7/00

[52] U.S. Cl. ..... 211/14; 211/87; 211/60.1; 211/175

[58] Field of Search ..... 211/14, 13, 87, 60.1, 211/35, 37, 70.6, 105.1, 123, 90, 4, 175

[56] References Cited

U.S. PATENT DOCUMENTS

| | | | |
|---|---|---|---|
| 466,608 | 1/1892 | Landis | 211/90 |
| 913,228 | 2/1909 | McCarthy | 211/90 X |
| 1,733,487 | 10/1929 | Hackley | 211/35 |
| 2,090,108 | 8/1937 | Cicero | 211/35 |
| 2,271,784 | 2/1942 | Tritt | 211/90 |
| 2,767,854 | 10/1956 | Barrett . | |
| 3,288,241 | 1/1974 | Ravreby | 211/188 X |
| 3,650,407 | 3/1972 | Benham, Jr. . | |
| 3,698,563 | 10/1972 | Gordon et al. . | |
| 3,888,353 | 6/1975 | Leifheit | 211/37 |
| 4,002,241 | 1/1977 | Parrilla, Sr. . | |
| 4,049,126 | 9/1977 | Halverson . | |
| 4,154,442 | 5/1979 | Trubody et al. | 211/13 X |
| 4,193,495 | 3/1980 | Keeley . | |
| 4,227,710 | 10/1980 | Laub . | |
| 4,561,547 | 12/1985 | Estwanik, III . | |
| 4,643,317 | 2/1987 | Wilkinson et al. . | |
| 4,674,967 | 6/1987 | Oseka | 248/11.2 X |
| 4,676,539 | 6/1987 | Potocnjak . | |
| 4,776,650 | 10/1988 | Ferenzi | 211/13 X |
| 4,854,456 | 8/1989 | Lee | 211/70.5 X |

FOREIGN PATENT DOCUMENTS

| | | |
|---|---|---|
| 096105 | 2/1988 | Taiwan . |

*Primary Examiner*—Robert W. Gibson, Jr.
*Attorney, Agent, or Firm*—Weston, Hurd, Fallon, Paisley & Howley

[57] ABSTRACT

A sports equipment rack includes a pair of spaced frame members connected to, and projecting from, a vertically extending wall. The frame members are connected by a plurality of laterally extending, tubular members. The tubular members are arranged relative to each other and to the wall so that items of sports equipment of different sizes can be held in place against the wall. The frame members preferably are formed in a molding operation from a plastics material. The tubular members preferably are formed in telescopically connected sections that can laterally space the frame members a desired distance from each other. The rack also includes baseball bat holders that are secured to the frame members, and hooks that project from the frame members.

23 Claims, 2 Drawing Sheets

SPORTS EQUIPMENT RACK

BACKGROUND OF THE INVENTION

1. Field of the Invention

The invention relates to techniques for holding various items of sports equipment and, more particularly, to a sports equipment rack that is adapted to be attached to a wall.

2. Description of the Prior Art

There are a variety of known sports equipment racks and holders. One known holder, as exemplified by U.S. Pat. No. 4,561,547, can be suspended from the ceiling. Other sports equipment racks and holders are known that are adapted to hold particular kinds of equipment, particularly baseball bats and balls. These holders, as exemplified by U.S. Pat. Nos. 3,698,563; 4,049,126; 4,193,495; and 4,227,710, include shelf-like members or prongs that form receptacles for baseball bats. The holders can be attached to vertical surfaces such as a baseball batting cage, or they can be wheeled about from place to place. A drawback of the referenced devices is that they primarily can be used to hold only baseball equipment.

Other types of sports equipment racks and holders also are known. U.S. Pat. No. 2,767,854 discloses a solid, wall-mounted rack adapted to hold equipment for such games as table tennis and badminton. U.S. Pat. No. 4,643,317 discloses a similar device. A drawback of the referenced devices is that they are adapted to hold sports equipment for only certain sports, and they either cannot hold other sports equipment or they can do so only with great difficulty or modification.

Yet an additional type of sports equipment rack is shown in U.S. Pat. Nos. 3,650,407 and 4,002,241. Although the referenced devices are capable of supporting both balls and bats, as well as other objects, they are formed from solid materials such as blow-molded sheets of plastic. The resultant structures thus are limited in size due to whatever size limitations may be imposed by the molding equipment.

The devices referred to do not disclose any structure suitable for supporting a large number of balls and related sports equipment, including bats. Desirably, a sports equipment rack would be available that would be lightweight, inexpensive to manufacture, compact for purposes of shipping and storage, and yet, when assembled, would be capable of holding a large number and variety of sports equipment items, including baseball bats.

SUMMARY OF THE INVENTION

In response to the foregoing concerns, the present invention provides a new and improved sports equipment rack. The rack according to the invention includes first and second frame members that are attached to, and project outwardly from a wall. The frame members are located at about the same vertical elevation. At least one rod extends between, and connects, the first and second frame members. The rod is spaced a sufficient distance from the wall that sports items can be held in place against the wall.

In the preferred embodiment, a plurality of generally parallel rods are provided. The rods are arranged relative to each other and to the wall such that a variety of different-sized sports items can be held in place.

The invention also preferably includes at least one baseball bat holder that is attached to the frame member. The baseball bat holder is in the form of a laterally extending shelf that has a plurality of notches along an exposed edge. The notches are of a size and shape so as to receive the knob end of a conventional baseball bat. The frame members also include outwardly projecting hooks adapted to receive such items as baseball gloves, hats, tennis racket covers, and the like.

Preferably, the frame members will be manufactured inexpensively in a molding operation from a plastics material. The frame members include formations for receiving the rods, which formations are defined by truss-like members. The frame members, in cross-section, define an I-beam-type structure consisting of a web and laterally extending flanges. The foregoing construction enables the frame members to be exceedingly lightweight and inexpensive. Also, the rods preferably are provided in multiple sections that can be assembled in a telescopic manner. By appropriately selecting the length and number of the sections, the rods can be provided in any desired length, consistant with the strength requirements necessary for the sports equipment being retained.

The sports equipment rack according to the invention has a number of advantages compared with prior art sports equipment holders. As already indicated, the frame members are lightweight and inexpensive to manufacture. Due to their particular cross-sectional configuration, they are exceedingly strong. Because the frame members are not connected to each other except by means of the laterally extending rods, the frame members can be spaced as close together, or as far apart, as the assembled rods themselves will permit. The rack according to the invention thus can be adapted to accomodate space limitations that may exist.

The foregoing, and other features and advantages of the invention, will be apparent from the specification and claims that follow, taken in conjunction with the accompanying drawings.

DESCRIPTION OF THE PREFERRED EMBODIMENT

Figure 1:
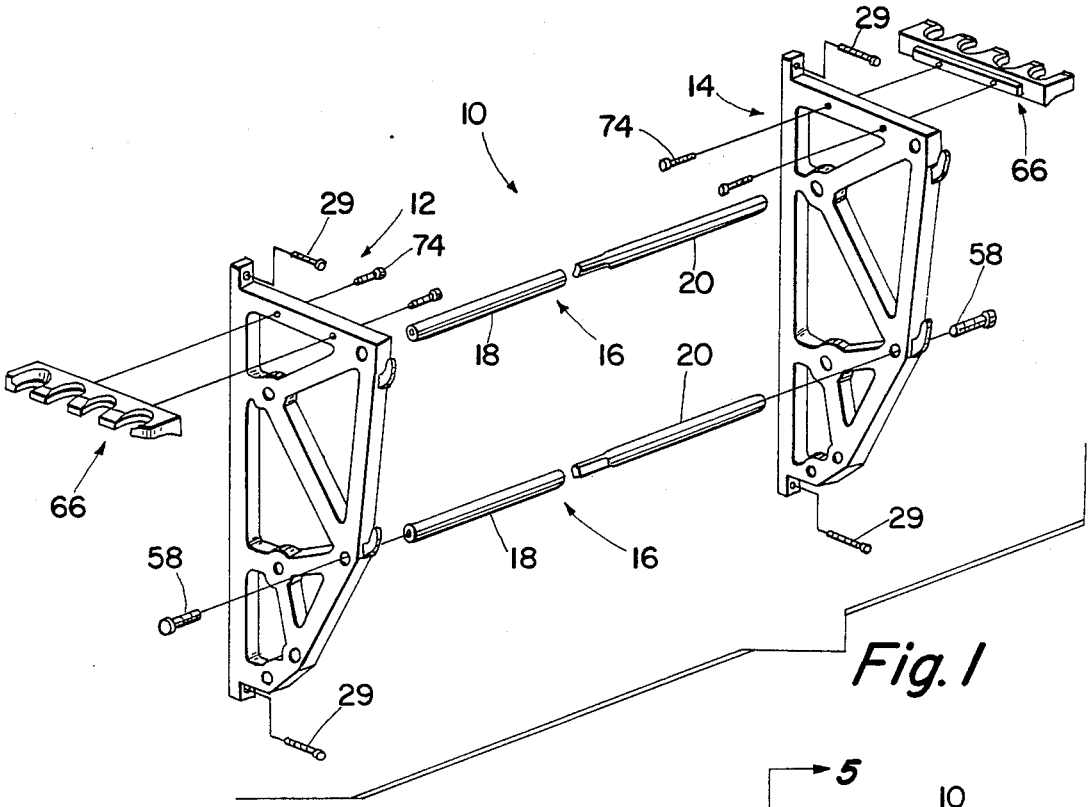
FIG. 1 is an exploded perspective view of the sports equipment rack according to the invention.
Figure 2:
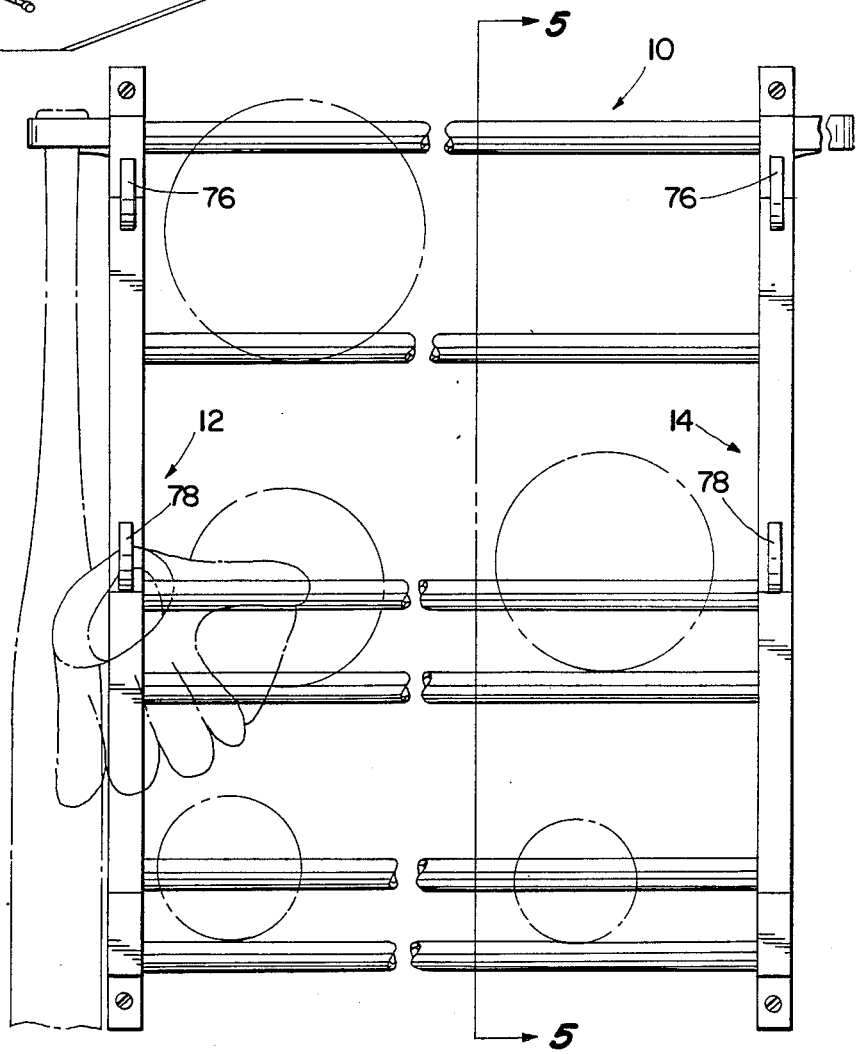
FIG. 2 is a front elevational view of the rack of FIG. 1, showing, in phantom, various items of sports equipment being held in place.
Figure 3:
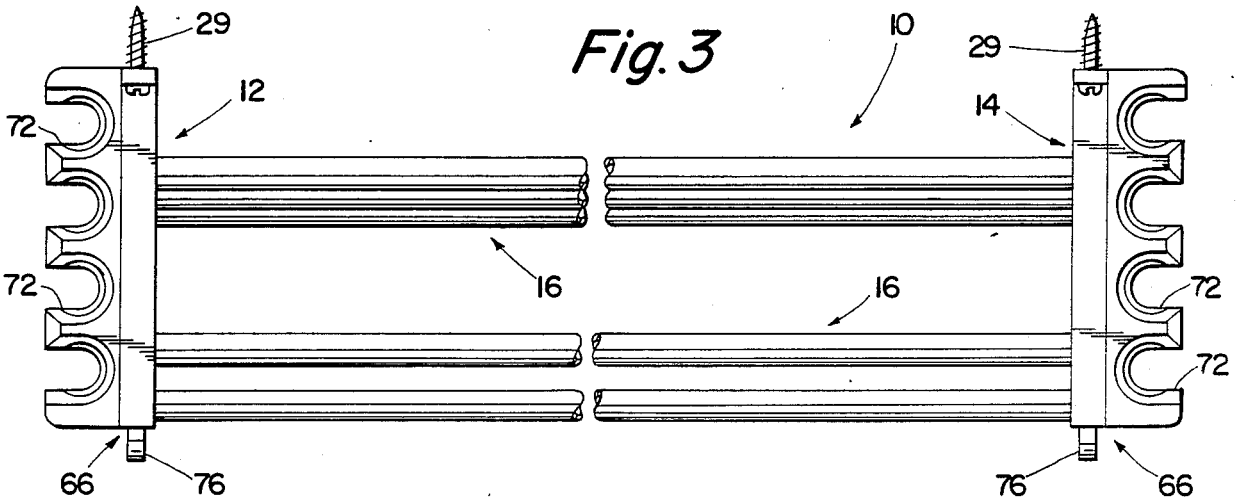
FIG. 3 is a top plan view of the rack of FIG. 2.

Referring to the various Figures, a sports equipment rack accordinq to the invention is identified by the reference numeral 10. The rack 10 includes first and second frame members 12, 14 that are attached to, and project from, a wall (not shown). It is to be understood that the wall to which the rack 10 is attached can be any type of generally planar, generally vertically extending member.

The frame members 12, 14 are substantially identical, being mirror images of each other. Accordingly, identical reference numerals will be used, where appropriate.

The frame members 12, 14 are joined by a plurality of laterally extending, tubular, connecting rods 16. Each of the rods 16 includes a first section 18, and a second section 20. The section 20 has a reduced-diameter, swaged end 22 that is adapted to be telescopically connected to one end of the first section 18. As will be apparent from an examination of FIG. 1, upon insertion of the swaged end 22 into one end of the rod 18, the rod 16 will be formed in a fixed length. If it is desired to space the frame members 12, 14 a small distance (as might be necessary due to space limitations), the rod 16 could be defined only by the first section 18. It also is possible to provide additional sections (not shown) that would space the frame members 12, 14 a greater distance. In general, the number and length of the sections that constitute the rods 16 can be selected as may be desired so as to accommodate any applicable space limitations, and so that whatever items of sports equipment are held in place by the rack 10 will be held securely.

The rods 16 are made of galvanized steel. It is possible for the rods to be made of other materials or to be provided in cross-sections other than circular, including solid cross-sections. The configuration illustrated is preferred due to its relative inexpensiveness and light weight.

The frame members 12, 14 each are defined by a rear section 24, a front section 26, and a top section 28. When viewed from the side (FIGS. 4 and 5), the sections 24, 26, 28 define a generally triangular structure, with the sections 24, 28 being connected to each other at right angles. The rear section 24 includes openings near its top and bottom adapted to receive threaded fasteners 29 for attachment to the wall. It is possible for other types of fasteners to be used to attach the rack 10 to other types of walls, or structures, such as batting cages, dugout walls and the like.

Figure 4:
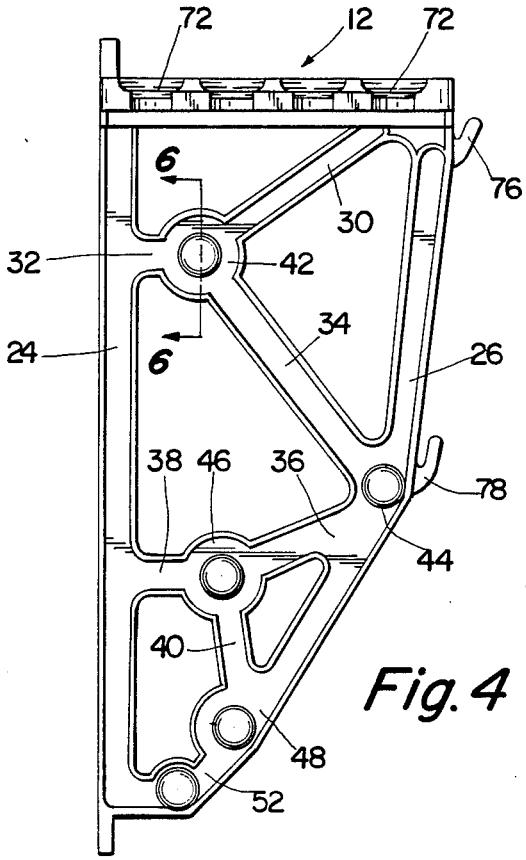
FIG. 4 is a side elevational view of the rack of FIG. 2, taken from the left as viewed in FIG. 2.
Figure 5:
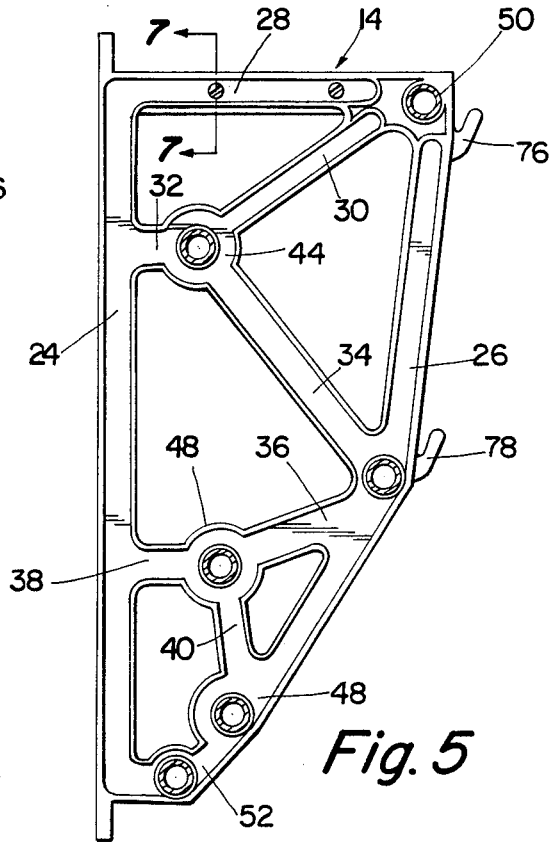
FIG. 5 is a side elevational view of the rack of FIG. 2, taken along a plane indicated by line 5—5 in FIG. 2.

A plurality of trusses 30, 32, 34, 36, 38, 40 are connected to the sections 24, 26, 28 and to each other. Referring particularly to FIGS. 4 and 5, the truss 30 projects from the underside of the top section 28 toward the rear section 24. The truss 32 projects from the rear section 24 toward the front section 26. A formation 42 is defined at the intersection of the trusses 30, 32. The truss 34 projects from the formation 42 toward the front section 26 where a formation 44 is formed. The truss: 36 projects from the formation 44 towards the rear section 24, while the truss 38 projects from the rear section 24 toward the front section 26. A formation 46 is formed at the intersection of the trusses 36, 38. The truss 40 extends from the formation 46 toward the front section 26 where a formation 48 is formed. A formation 50 also is formed at the uppermost, front portion of the frame members 12, 14 at the intersection of the front section 26, the top section 28, and the truss 30. A formation 52 also is formed near the lowermost portion of the front section 26, adjacent its intersection with the rear section 24.

Figure 6:
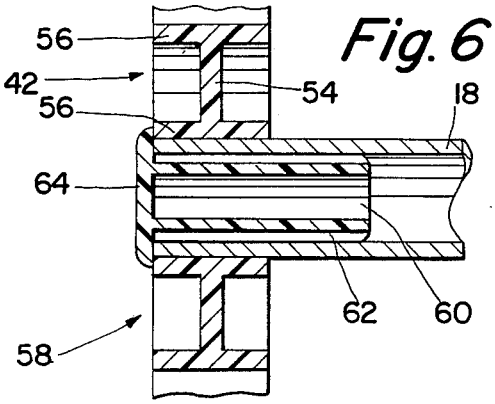
FIG. 6 is an enlarged, cross-sectional view of a portion of the rack of FIG. 2, taken along a plane indicated by line 6—6 in FIG. 4.

Referring particularly to FIG. 6, the formation 42 is shown in cross section. It is to be understood that the remaining formations 44, 46, 48, 50, 52 are constructed similarly. The formation 42, like the remainder of the frame members 12, 14, is defined by an I-beam-type construction consisting of a web 54 and laterally extending flanges 56. The resultant construction is very strong and lightweight. The flange 56 defining the central portion of the formation 42 is cylindical in cross section, and is adapted to receive the tubular end of the rod sections 18, 20. The rod section 18 is held in place within the formation 42 by means of a plug 58. The plug 58 is defined by a generally tubular body portion 60 having longitudinally extending splines disposed about its outer surface. One end of the body portion 60 is closed by a cap 64, which cap 64 has an outer diameter sufficient to close the opening extending through the formation 42.

Figure 7:
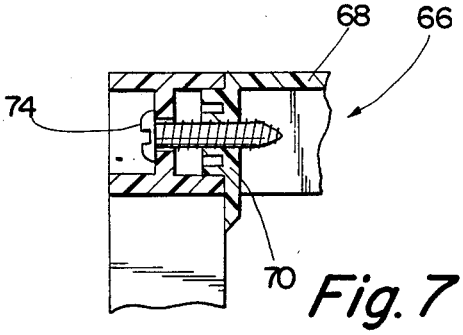
FIG. 7 is an enlarged, cross-sectional view of a portion of the rack of FIG. 2 taken along a plane indicated by line 7—7 in FIG. 5.

The rack 10 also includes a baseball bat holder 66 that is connected to each of the frame members 12, 14. The holder 66 is in the form of a laterally extending shelf 68 having a depending flange 70. A plurality of notches 72 are formed along one edge of the shelf 68. The notches 72 are appropriately countersunk and counterbored so as to create recesses suitable for receiving the knobbed end of a conventional baseball bat. The holders 66 are secured to the frame members 12, 14 by means of threaded fasteners 74 that extend through openings formed in the depending flange 70 (FIG. 7). The holders 66 provide rigidity for the rack 10 by preventing sideways flexing of the frame members 12, 14.

The frame members 12, 14 each include outwardly projecting hooks 76, 78. The hook 76 is an integral portion of the front section 2 and projects outwardly from the front section 26 at a location adjacent the formation 50. The hook 78 is similar in construction to the hook 76, and projects outwardly from the front section 26 at a location adjacent the formation 44.

It is expected that the frame members 12, 14, as well as the holders 66, will be manufactured inexpensively in a molding operation from a plastics material such as ABS. Those skilled in the art will be aware of suitable materials for the frame members 12, 14, and the holders 66, and further discussion here is unnecessary.

As will be apparent from the foregoing description, the rack 10 according to the invention is exceedingly inexpensive, easy to manufacture, and lightweight. It can be stored and shipped compactly, and yet it can be expanded in use to accomodate a large number and variety of sports equipment. As indicated previously, by forming the rod 16 from various numbers and lengths of rod sections, the frame members 12, 14 can be spaced any desired distance. By positioning the formations 42, 44, 46, 48, 50, 52 in appropriate positions relative to each other and to the wall, a wide variety of sports equipment can be securely held in place. In particular, it will be apparent that the formations 42, 50 are positioned so as to enable large objects such as basketballs to be held in place. Similarly, the formations 44, 46 enable medium-sized objects such as footballs and soccer balls to be held in place, while the formations 48, 52 enable small objects such as baseballs and tennis balls to be held in place. It is expected that the wall will cooperate with the various rods 16 to hold objects in place, but it is not essential that the wall perform such a function. Obviously, the size of the objects being held is an important factor in whether both of any two adjacent rods and the wall, or only two of the rods, or only one of the rods and the wall will hold the objects in place.

Although the invention has been described in its preferred embodiment with a certain degree of particularity, it will be understood that the various components of the invention and their arrangement can be modified within the true spirit and scope of the invention as hereinafter claimed. It is intended that the patent shall cover, by suitable expression in the appended claims, whatever degree of patentable novelty exists in the invention disclosed.

What is claimed is:

1. A sports equipment rack for attachment to a wall, the rack adapted to hold various items of sports equipment, comprising:

a first frame member, the first frame member being attached to the wall and projecting therefrom;

a second frame member spaced from the first frame member and being located at about the same elevation as the first frame member, the second frame member being attached to the wall and protecting therefrom;

first rod means extending between, and connected to, the first and second frame members for connecting the frame members to each other, the first rod means being spaced from the wall a sufficient distance that items of sports equipment can be held in place against the wall;

second rod means extending between, and connected to, the first and second frame members, the second rod means being disposed generally parallel to the first rod means, the second rod means being located at a lower elevation than the first rod means and being disposed closer to the wall than the first rod means; and third and fourth rod means extending between, and connected to, the first and second frame members, the third and fourth rod means being disposed generally parallel to the first and second rod means, the third rod means being located at a lower elevation than the second rod means and being spaced from the wall a distance between the first and second rod means, and the fourth rod means being located at a lower elevation than the third rod means and being disposed closer to the wall than the third rod means.

2. The rack of claim 1, further comprising fifth and sixth rod means extending between, and connected to, the first and second frame members, the fifth and sixth rod means being disposed generally parallel to the first, second, third and fourth rod means, the fifth rod means being located at a lower elevation than the fourth rod means and being spaced from the wall a distance between the third and fourth rod means, and the sixth rod means being located at a lower elevation than the fifth rod means and being disposed closer to the wall than the fifth rod means.

3. The rack of claim 1, wherein each of the rod means includes at least two sections connected together in a telescopic manner.

4. The rack of claim 1, wherein each of the rod means is in the form of an elongate member having a circular cross-section.

5. The rack of claim 1, further comprising a baseball bat holder connected to at least one of the frame members, the holder extending laterally from the frame member.

6. The rack of claim 5, wherein the baseball bat holder is in the form of a shelf connected to the frame member, the shelf including a plurality of notches of a size and shape adapted to receive the knob end of a conventional baseball bat.

7. The rack of claim 1, further comprising a hook projecting from at least one of the frame members.

8. The rack of claim 7, wherein a first hook is disposed adjacent the upper portion of the frame member, and a second hook is disposed adjacent the middle of the frame member.

9. The rack of claim 1, wherein the frame members are formed in a molding operation from a plastics material.

10. The rack of claim 1, wherein the frame members, in cross-section, define an I-beam-type construction having a web and laterally extending flanges.

11. A sports equipment rack for attachment to a wall, the rack adapted to hold various items of sports equipment, comprising:

a first frame member, the first frame member being attached to the wall and projecting therefrom, the first frame member being manufactured in a molding operation from a plastics material, the first frame member being defined by top, rear, and front sections, the sections being connected by trusses, the first frame member further including a plurality of formations at the intersection of the trusses and the sections;

a second frame member, the second frame member being attached to the wall and projecting therefrom, the second frame member being manufactured in a molding operation from a plastics material, the second frame member being defined by top, rear, and front sections, the sections being connected by trusses, the second frame member further including a plurality of formations at the intersection of the trusses and the sections; and a plurality of rods extending between, and connected to, the first and second frame members, the rods being generally tubular in configuration and engaging the first and second frame members by being connected to the formations, the rods being positioned relative to each other and to the wall so as to hold items of various sizes.

12. The rack of claim 11, further comprising baseball bat holders connected to the frame members, the holders extending laterally from the frame members, each holder being in the form of a shelf connected to a frame member, the shelf including a plurality of notches of a size and shape adapted to receive the knob end of a conventional baseball bat.

13. The rack of claim 11, further comprising hooks projecting outwardly from the front section of the first and second frame members.

14. The rack of claim 11, wherein six rods are provided, the rods being generally parallel with each other, the first rod being disposed adjacent the intersection of the front sections and the top sections of the frame members, the second rod being located at a lower elevation than the first rod and being disposed closer to the rear sections than the first rod, the third rod being located at a lower elevation than the second rod and being spaced from the rear sections a distance between the first and second rods, the fourth rod being located at a lower elevation than the third rod and being disposed closer to the rear sections than the third rod, the fifth rod being located at a lower elevation than the fourth rod and being spaced from the rear sections a distance between the third and fourth rods, and the sixth rod being located at a lower elevation than the fifth rod and being disposed closer to the rear sections than the fifth rod.

15. A sports equipment rack for attachment to a wall, the rack adapted to hold various items of sports equipment, comprising:

a first frame member, the first frame member being attached to the wall and projecting therefrom, the first frame member being manufactured in a molding operation from a plastics material, the first frame member being defined by top, rear, and front sections, the sections being connected by trusses, the first frame member further including a plurality of formations at the intersection of the trusses and the sections;

a second frame member, the second frame member being attached to the wall and projecting therefrom, the second frame member being manufactured in a molding operation from a plastics material, the second frame member being defined by top, rear, and front sections, the sections being connected by trusses, the second frame member further including a plurality of formations at the intersection of the trusses and the sections;

six rods extending between, and connected to, the first and second frame members, the rods being generally tubular in configuration and engaging the first and second frame members by being connected to the formations, the rods being positioned relative to each other and to the wall so as to hold items of various sizes, the rods being positioned generally parallel to each other, the first rod being disposed adjacent the intersection of the front sections and the top sections of the frame members, the second rod being located at a lower elevation than the first rod and being disposed closer to the rear sections than the first rod, the third rod being located at a lower elevation than the second rod and being spaced from the rear sections a distance between the first and second rods, the fourth rod being located at a lower elevation than the third rod and being disposed closer to the rear sections than the third rod, the fifth rod being located at a lower elevation than the fourth rod and being spaced from the rear sections a distance between the third and fourth rods, and the sixth rod being located at a lower elevation than the fifth rod and being disposed closer to the rear sections than the fifth rod;

baseball bat holders connected to the frame members, the holders extending laterally from the frame members, each holder being in the form of a shelf connected to a frame member, the shelf including a plurality of notches of a size and shape adapted to receive the knob end of a conventional baseball bat; and hooks projecting outwardly from the front section of the first and second frame members.

16. A sports equipment rack for attachment to a wall, the rack adapted to hold various items of sports equipment, comprising:

a first frame member, the first frame member being attached to the wall and projecting therefrom;

a second frame member spaced from the first frame member and being located at about the same elevation as the first frame member, the second frame member being attached to the wall and protecting therefrom;

rod means extending between, and connected to, the first and second frame members for connecting the frame members to each other, the rod means being spaced from the wall a sufficient distance that items of sports equipment can be held in place against the wall; and a baseball bat holder connected to at least one of the frame members, the holder extending laterally from the frame member.

17. The rack of claim 16, wherein the baseball bat holder is in the form of a shelf connected to the frame member, the shelf including a plurality of notches of a size and shape adapted to receive the knob end of a conventional baseball bat.

18. The rack of claim 16, further comprising a hook projecting from at least one of the frame members.

19. The rack of claim 18, wherein a first hook is disposed adjacent the upper portion of the frame member, and a second hook is disposed adjacent the middle of the frame member.

20. The rack of claim 16, wherein the frame members are formed in a molding operation from a plastics material.

21. The rack of claim 16, wherein the frame members, in cross-section, define an I-beam-type construction having a web and laterally extending flanges.

22. The rack of claim 16, further comprising a plurality of generally parallel rod means extending between, and connected to, the frame members, the rod means being positioned relative to each other and to the wall so as to hold items of various sizes.

23. The rack of claim 22, wherein the rod means includes:

first rod means extending between, and connected to, the first and second frame members for connecting the frame members to each other, the first rod means being spaced from the wall a sufficient distance that items of sports equipment can be held in place against the wall;

second rod means extending between, and connected to, the first and second frame members, the second rod means being disposed generally parallel to the first rod means, the second rod means being located at a lower elevation than the first rod means and being disposed closer to the wall than the first rod means; and third and fourth rod means extending between, and connected to, the first and second frame members, the third and fourth rod means being disposed generally parallel to the first and second rod means, the third rod means being located at a lower elevation than the second rod means and being spaced from the wall a distance between the first and second rod means, and the fourth rod means being located at a lower elevation than the third rod means and being disposed closer to the wall than the third rod means.

* * * * *